US009732612B2

(12) United States Patent
Maynard

(10) Patent No.: US 9,732,612 B2
(45) Date of Patent: Aug. 15, 2017

(54) BARRIER FORMING APPARATUS

(71) Applicant: Glen Roy Maynard, Banyo (AU)

(72) Inventor: Glen Roy Maynard, Banyo (AU)

( * ) Notice: Subject to any disclaimer, the term of this patent is extended or adjusted under 35 U.S.C. 154(b) by 0 days.

(21) Appl. No.: 14/915,691

(22) PCT Filed: Sep. 4, 2014

(86) PCT No.: PCT/AU2014/000879
§ 371 (c)(1),
(2) Date: Mar. 1, 2016

(87) PCT Pub. No.: WO2015/031945
PCT Pub. Date: Mar. 12, 2015

(65) Prior Publication Data

US 2016/0208608 A1 Jul. 21, 2016

(30) Foreign Application Priority Data

Sep. 4, 2013 (AU) ..... 2013903390

(51) Int. Cl.
*E21D 9/06* (2006.01)
*E21D 9/10* (2006.01)

(52) U.S. Cl.
CPC ..... *E21D 9/0671* (2016.01); *E21D 9/06* (2013.01); *E21D 9/065* (2016.01); *E21D 9/0664* (2016.01); *E21D 9/10* (2013.01)

(58) Field of Classification Search
CPC ..... E21D 9/0671; E21D 9/065; E21D 9/0664; E21D 9/06; E21D 9/10
See application file for complete search history.

(56) References Cited

U.S. PATENT DOCUMENTS 4,789,267 A * 12/1988 Babendererde ..... E04G 21/06 264/426
4,793,736 A * 12/1988 Thompson ..... E21D 9/0873 405/138
4,915,541 A * 4/1990 Thompson ..... E21D 9/0873 405/141
5,645,375 A * 7/1997 Stephens ..... C04B 28/26 138/98

* cited by examiner

*Primary Examiner* — Tara M. Pinnock
(74) *Attorney, Agent, or Firm* — Abelman, Frayne & Schwab

(57) ABSTRACT

A barrier forming apparatus for forming a barrier between an exposed tunnel face (107) and a tunnel boring machine (100), the barrier being formed by the application to the tunnel face of a barrier mixture comprising two highly reactive first and second components. The barrier forming apparatus (10) includes a first reservoir (11) for storing the first component, a second reservoir (12) for storing the second component, and a plurality of applicators (13, 14 and 15). The barrier forming apparatus (10) also includes a third reservoir (56) that is used to store a clearing fluid and a piston flow divider (58) having an inlet (59) and three chambers having respective outlets, (61, 62 and 63) that are in fluid communication with a respective applicator (13, 14 and 15). The applicators are maintained in a state of readiness by a regular supply of clearing fluid passing there through.

10 Claims, 8 Drawing Sheets

BARRIER FORMING APPARATUS

Figure 1:
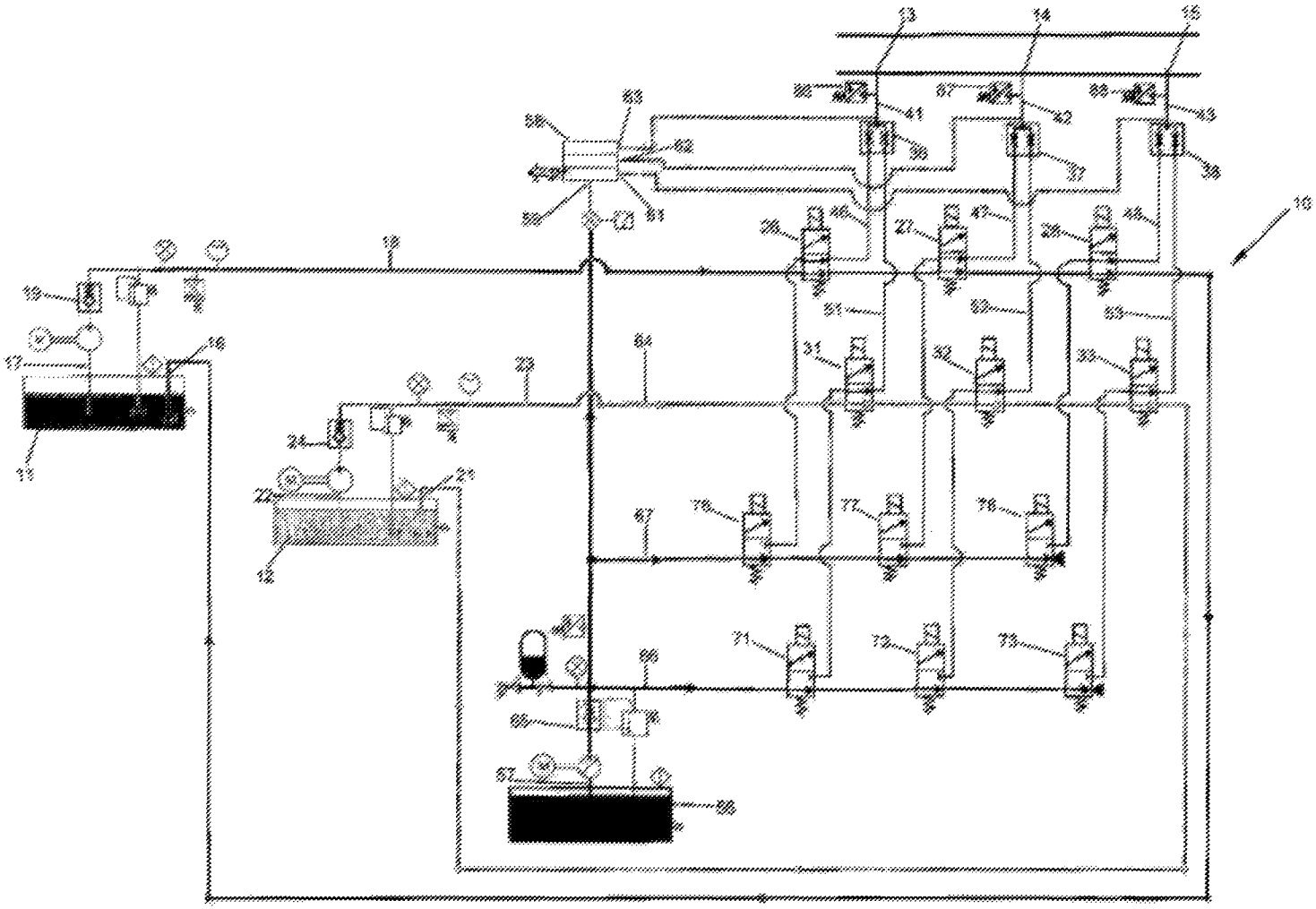

This invention relates to barrier forming apparatus that is capable of rapidly creating a barrier formed by mixing together two highly reactive components.

This invention has particular, but not exclusive, application to barrier forming apparatus for rapidly creating a barrier between an exposed tunnel face and a tunnel boring machine during the excavation of tunnels, and wherein reference will be made to same, including reference to an improved tunnel boring machine incorporating the barrier forming apparatus. However, it will be appreciated that the invention may be applied to other applications, including other underground mining equipment.

Tunnel boring machines are used to create tunnels, having a generally circular shaped transverse cross-section, often deep beneath the ground and in varying soil and rock strata. Tunnel diameters can range from a meter to 19.25 meters to date.

Tunnel boring machines typically include a forwardly located, rotating, cutting wheel, called a cutter head, followed by a main bearing, a thrust system and various trailing support mechanisms, including grippers.

Shielded tunnel boring machines typically include a generally cylindrically shaped shield that forms a shroud that is adapted to at least partially cover the main bearing and/or the thrust system and/or the various support mechanisms.

Some shielded tunnel boring machines include a cutter head that is adapted to cut a tunnel diameter that is larger than the nominal tunnel diameter. The larger over bored tunnel diameter provides increased annular clearances between the tubular body or shield of the tunnel boring machine and the excavated tunnel profile.

Shielded tunnel boring machines are typically used in the excavation of tunnels where geological conditions could be unfavourable, and in some cases even hinder, the excavation of tunnels, including conditions that pose a high risk to personnel and equipment due to the ingress of explosive gases and flowable materials, such as water and loose soil, and/or geological events.

Owners and operators of tunnel boring machines must also contend with the geological phenomenon known as "tunnel deformation" or "ground squeezing", which occurs when the stress loads applied to the tunnel walls exceed the freestanding limitations of the geology.

Generally speaking the threats posed by unfavourable geological conditions, such as those described above, would be avoided by the prompt installation of a barrier between the exposed tunnel face and a tunnel boring machine that will resist the ingress of explosive gases and flowable materials into the excavated cavity and inhibit further ground movement. Ideally this barrier would be installed immediately after the completion of a tunnel boring cycle or simultaneously behind the advancing tunnel boring machine. Alternatively, the barrier may be installed in response to perceived changes in local geological conditions.

Accordingly, tunnel boring machines may be equipped with barrier forming apparatus which may be used to form a barrier between an exposed tunnel face and a tunnel boring machine adjacent the machine and whereby this passive barrier will in most instances at least partially fill the annular void that previously existed between the shield and the tunnel face.

The material from which the barrier is formed comprises a mixture of two highly reactive components. The barrier mixture components are stored in separate reservoirs and are subsequently pumped through a mixing chamber, and whereby the resulting mixture is applied to the tunnel face by an applicator that either extends through or cooperates with an opening formed in the shield.

Immediately following the application of the barrier mixture the applicator, mixing chamber and the hose line connecting the applicator to the mixing chamber must be cleared of any residue barrier mixture which, due to its fast curing time, the barrier mixture often causes blockages if not cleared almost immediately. This clearing of barrier mixture could be achieved by the disconnection of the barrier forming apparatus to allow persons to flush out the mixing chamber and applicator with a suitable clearing solution. Whenever flushing is not completed prior to the setting of the barrier mixture, application personnel will be required to disassemble the applicator and the mixing chamber from the tunnel boring machine. While such costly time consuming maintenance of the barrier forming apparatus is being undertaken, the tunnel boring machine remains vulnerable to potential inrush or entrapment caused by ground squeezing and other changes in ground phenomena.

It is therefore an object of the present invention to provide a barrier forming apparatus and an improved tunnel boring machine incorporating said barrier forming apparatus which alleviates at least some of the deficiencies of the prior art and which will provide a reliable and efficient and economically viable means of forming barriers.

With the foregoing and other objects in view, this invention in one aspect relates to a barrier forming apparatus for forming a barrier between an exposed tunnel face and a tunnel boring machine, the barrier being formed by the application to the tunnel face of a barrier mixture comprising two highly reactive first and second components, said barrier forming apparatus including:

a first reservoir for storing the first component;

a second reservoir for storing the second component;

an applicator having an applicator outlet and an applicator inlet;

a mixing chamber having a first port that is in fluid communication with said first reservoir, a second port that is in fluid communication with said second reservoir and a third port that is in fluid communication with said applicator inlet;

clearing means that is adapted to expel residue barrier mixture contained in said applicator and said mixing chamber through said applicator, including a third reservoir for storing a clearing fluid, said third reservoir being in fluid communication with said applicator, and supply means for providing a regular flow of the clearing fluid to said applicator, and control means having monitoring means for monitoring the resistance to the flow of the clearing fluid through said applicator outlet, and actuation means for actuating the production of the barrier mixture in said mixing chamber and its subsequent disbursement by said applicator, whereby production of the barrier mixture may occur if there is no resistance to the flow of clearing fluid passing through said applicator outlet or the level of resistance does not exceed a predetermined limit.

Preferably the third reservoir is also in fluid communication with the first and second ports of the mixing chamber and whereby in use clearing fluid may enter the mixing chamber via said ports by an alternative path, or paths, to that used to provide a regular supply of the clearing fluid to the applicator. Further, it is preferred that clearing fluid entering the mixing chamber via said first and second ports is discharged from the apparatus via the applicator outlet.

In another aspect, this invention relates to a barrier forming apparatus for forming a barrier between an exposed tunnel face and a tunnel boring machine, the barrier being formed by the application to the tunnel face of a barrier mixture comprising two highly reactive first and second components, said barrier forming apparatus including:

a first reservoir for storing the first component;

a second reservoir for storing the second component;

an applicator having an applicator outlet and an applicator inlet;

a mixing chamber having a first port that is in fluid communication with said first reservoir, a second port that is in fluid communication with said second reservoir and a third port that is in fluid communication with said applicator inlet;

clearing means that is adapted to expel residue barrier mixture contained in said applicator and said mixing chamber through said applicator, including a third reservoir for storing a clearing fluid that is in fluid communication with said first and said second ports via respective first and second paths, said third reservoir being also in fluid communication with said applicator via a third path and whereby said clearing means includes supply means for providing a regular supply of the clearing fluid to said applicator via said third path, and control means having monitoring means for monitoring the resistance to the flow of the clearing fluid through said applicator outlet, and actuation means for actuating the production of the barrier mixture in said mixing chamber and its subsequent disbursement by said applicator, whereby production of the barrier mixture may occur if there is no resistance to the flow of clearing fluid passing through said applicator outlet or the level of resistance does not exceed a predetermined limit.

Preferably the supply means is a pump and preferably the same pump is used to also supply clearing fluid to the mixing chamber via said first and second paths. However, it will be appreciated that there may be provided two pumps and whereby the first pump may be adapted to pump fluid drawn from the third reservoir along the first and second paths while the second pump is adapted to pump fluid drawn from the third reservoir along the third path.

Preferably the control means also controls the quantity of barrier mixture that is produced. For example, the control means may discontinue the production of barrier mixture if the resistance to the flow of the barrier mixture passing through the applicator exceeds a predetermined level or if the predetermined injection volume is completed.

Preferably, the control means is adapted to initiate clearing of the mixing chamber and the applicator upon termination of the production of the barrier mixture. Preferably the clearing of the mixing chamber and applicator of barrier mixture is achieved by introducing clearing fluid into the mixing chamber via the first and second paths.

Preferably the supply means is capable of supplying the clearing fluid at a pressure sufficiently high enough to clear the mixing chamber and the applicator of residue barrier mixture. For example, the pressure may be as high as 300 bar.

In still yet another aspect, this invention relates to a barrier forming apparatus for forming a barrier between an exposed tunnel face and a tunnel boring machine, the barrier being formed by the application to the tunnel face of a barrier mixture comprising two highly reactive first and second components, said barrier forming apparatus including:

a first reservoir for storing the first component;

a second reservoir for storing the second component;

a plurality of applicators each having an applicator outlet and an applicator inlet;

a plurality of mixing chambers each having a first port that is in fluid communication with said first reservoir, a second port that is in fluid communication with said second reservoir and a third port that is in fluid communication with a respective one of said applicator inlets;

clearing means that is adapted to expel residue barrier mixture contained in said applicators and said mixing chambers through said applicators, including a third reservoir for storing a clearing fluid, said third reservoir being in fluid communication with each of said applicators, and supply means for supplying a regular flow of the clearing fluid to each of said applicators;

control means having monitoring means for monitoring the resistance to the flow of the clearing fluid through said applicator outlets, and actuation means for actuating the production of the barrier mixture in said mixing chambers and its subsequent disbursement by said applicators, whereby the production of barrier mixture in any one of said mixing chambers may occur if there is no resistance to the flow of clearing fluid passing through said applicator in fluid communication with said mixing chamber, or the level of resistance does not exceed a predetermined limit.

Preferably the assessment of each applicator's suitability to disburse the barrier mixture and the possible production of barrier mixture in a mixing chamber that is in fluid communication with said applicator follows a predetermined sequence.

Further, preferably the production of barrier mixture in a mixing chamber will only occur once production of barrier mixture in the preceding mixing chamber of the sequence has been terminated.

Preferably, the clearing of residue barrier mixture contained in a mixing chamber and an applicator that is in fluid communication with said mixing chamber will occur immediately the supply of reactive components to that mixing chamber has ceased.

In still yet another aspect, this invention relates to a barrier forming apparatus for forming a barrier between an exposed tunnel face and a tunnel boring machine, the barrier being formed by the application to the tunnel face of a barrier mixture comprising two highly reactive first and second components, said barrier forming apparatus including:

a first reservoir for storing the first component;

a second reservoir for storing the second component;

a plurality of applicators each having an applicator outlet and an applicator inlet;

a plurality of mixing chambers each having a first port that is in fluid communication with said first reservoir, a second port that is in fluid communication with said second reservoir and a third port that is in fluid communication with a respective one of said applicator inlets;

clearing means that is adapted to expel residue barrier mixture contained in said applicators and said mixing chambers through said applicators, including a third reservoir for storing a clearing fluid, said third reservoir being in fluid communication with each of said applicators, and supply means for supplying a regular flow of the clearing fluid to each of said applicators;

control means having monitoring means for the sequential monitoring of resistance to the flow of the clearing fluid through each of said applicator outlets, and actuation means for actuating the production of the barrier mixture in said mixing chambers in sequential order and its subsequent disbursement by said applicators and the clearing of barrier mixture from said mixing chambers and said applicators immediately the supply of reagents to a mixing chamber is terminated, and whereby the production of barrier mixture in any one of said mixing chambers may occur if there is no resistance to the flow of clearing fluid passing through said applicator in fluid communication with said mixing chamber, or the level of resistance does not exceed a predetermined limit.

In another aspect, this invention relates to a method of forming a barrier using a barrier mixture composed of two highly reactive components, said method including:

providing a mixing chamber that is in fluid communication with a first reservoir containing a first component and in fluid communication with a second reservoir containing a second component;

providing an applicator having an outlet and an inlet in fluid communication with said mixing chamber;

providing a third reservoir containing a clearing fluid, said third reservoir being in fluid communication with said mixing chamber and said applicator;

providing a regular supply of the clearing fluid to the applicator so as to maintain the applicator free of obstructions, the clearing fluid being permitted exit said applicator via the applicator's outlet;

if the applicator is not obstructed, supplying the mixing chamber with a quantity of the first and second components so as to form a barrier mixture;

using the applicator to disburse the barrier mixture, and using the clearing fluid drawn from the third reservoir to flush residue barrier mixture from the mixing chamber and the applicator.

In still yet another embodiment this invention relates to a tunnel boring machine of the type having a forwardly located, rotating cutting wheel, followed by a main bearing, a thrust system and various trailing support mechanisms, said tunnel boring machine also having a barrier forming apparatus for forming a barrier between an exposed tunnel face and the tunnel boring machine adjacent the machine, the barrier being formed by the application to the surface of a barrier mixture comprising two highly reactive first and second components, said tunnel boring machine including:

a first reservoir for storing the first component;

a second reservoir for storing the second component;

an applicator having an applicator outlet and an applicator inlet;

a mixing chamber having a first port that is in fluid communication with said first reservoir, a second port that is in fluid communication with said second reservoir and a third port that is in fluid communication with said applicator inlet;

clearing means that is adapted to expel residue barrier mixture contained in said applicator and said mixing chamber through said applicator, including a third reservoir for storing a clearing fluid, said third reservoir being in fluid communication with said applicator, and supply means for providing a regular flow of the clearing fluid to said applicator, and control means having monitoring means for monitoring the resistance to the flow of the clearing fluid through said applicator outlet, and actuation means for actuating the production of the barrier mixture in said mixing chamber and its subsequent disbursement by said applicator, whereby production of the barrier mixture may occur if there is no resistance to the flow of clearing fluid passing through said applicator outlet or the level of resistance does not exceed a predetermined limit.

Figure 2:
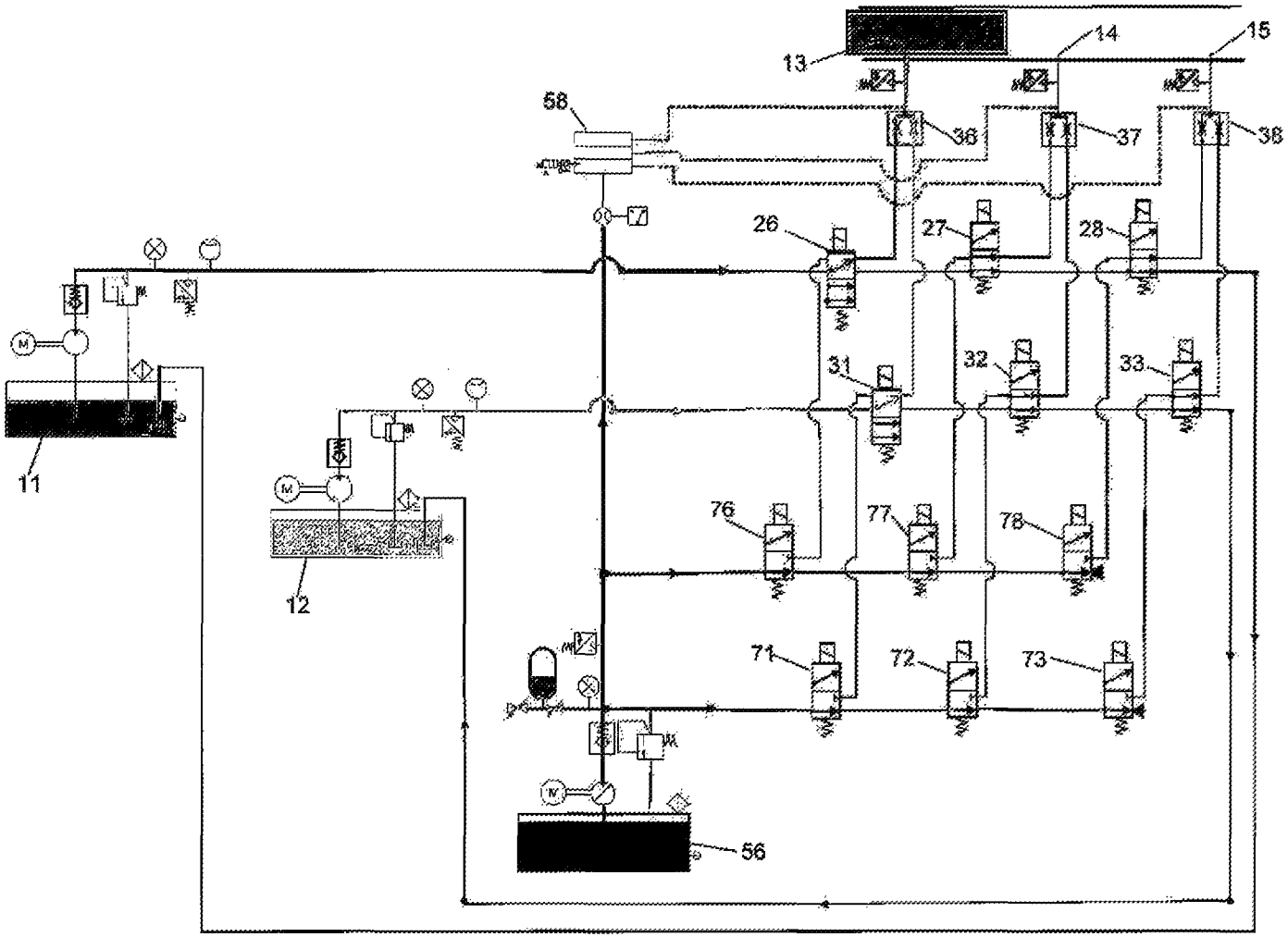
Figure 3:
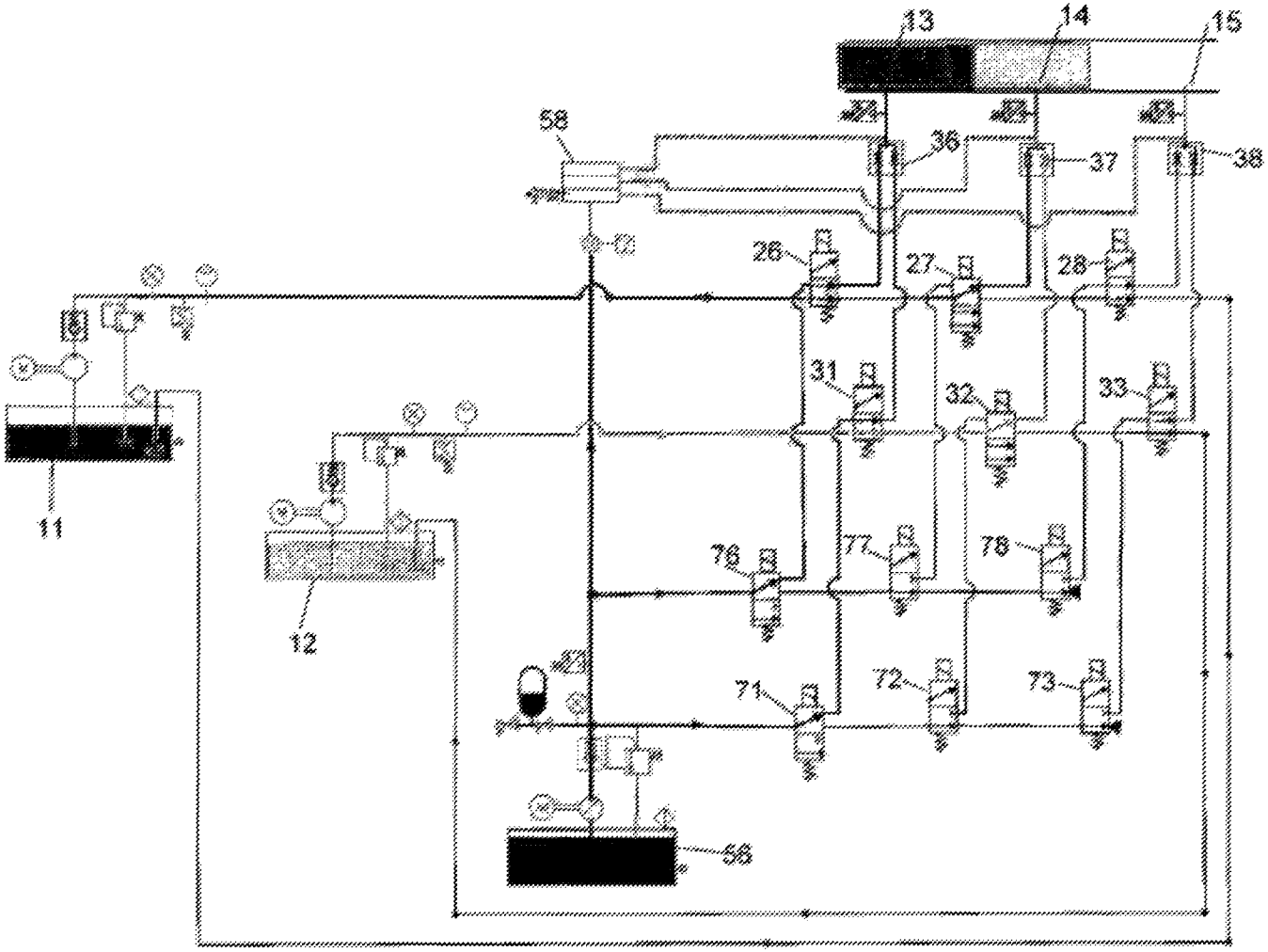
Figure 4:
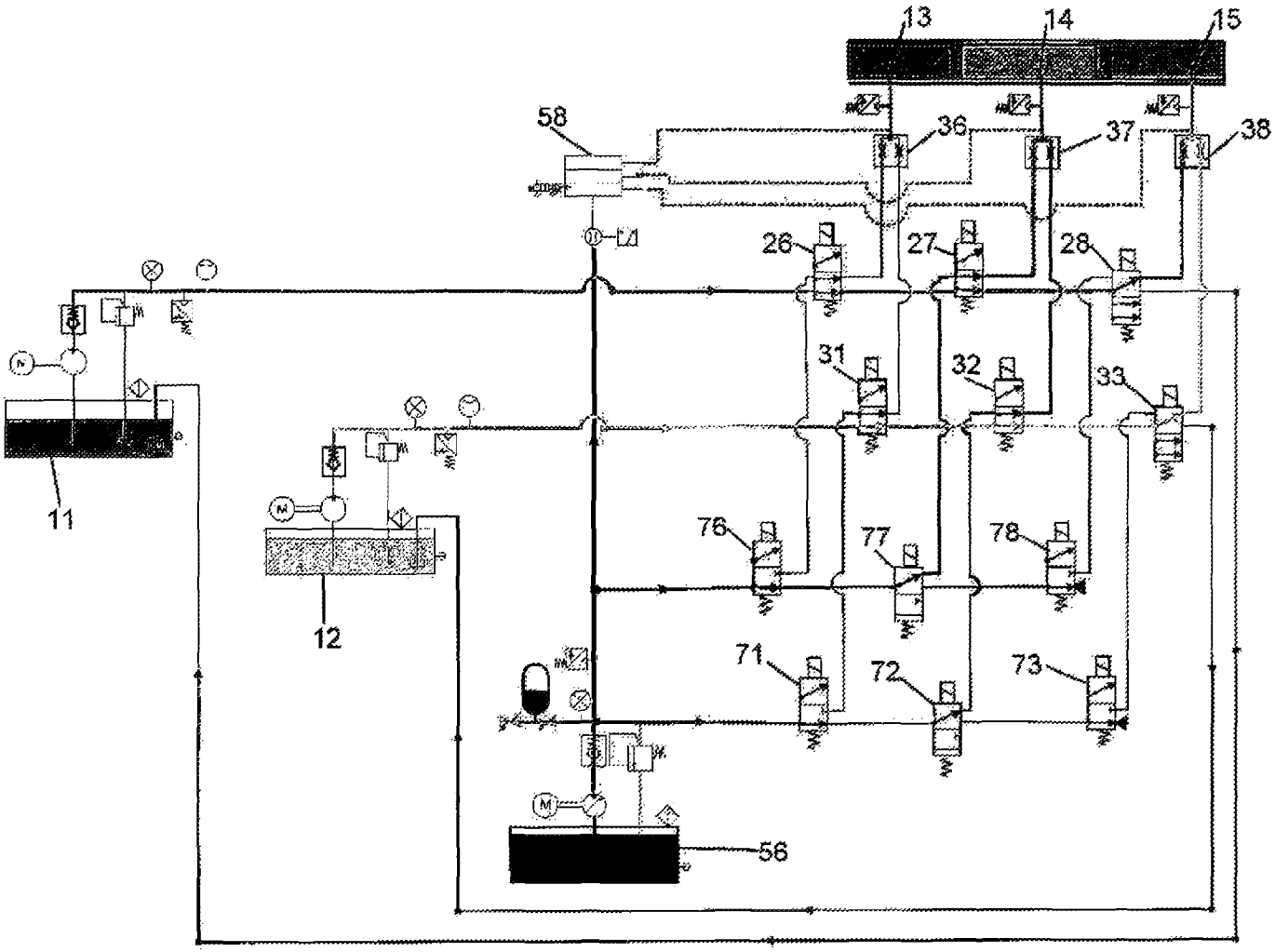
Figure 5:
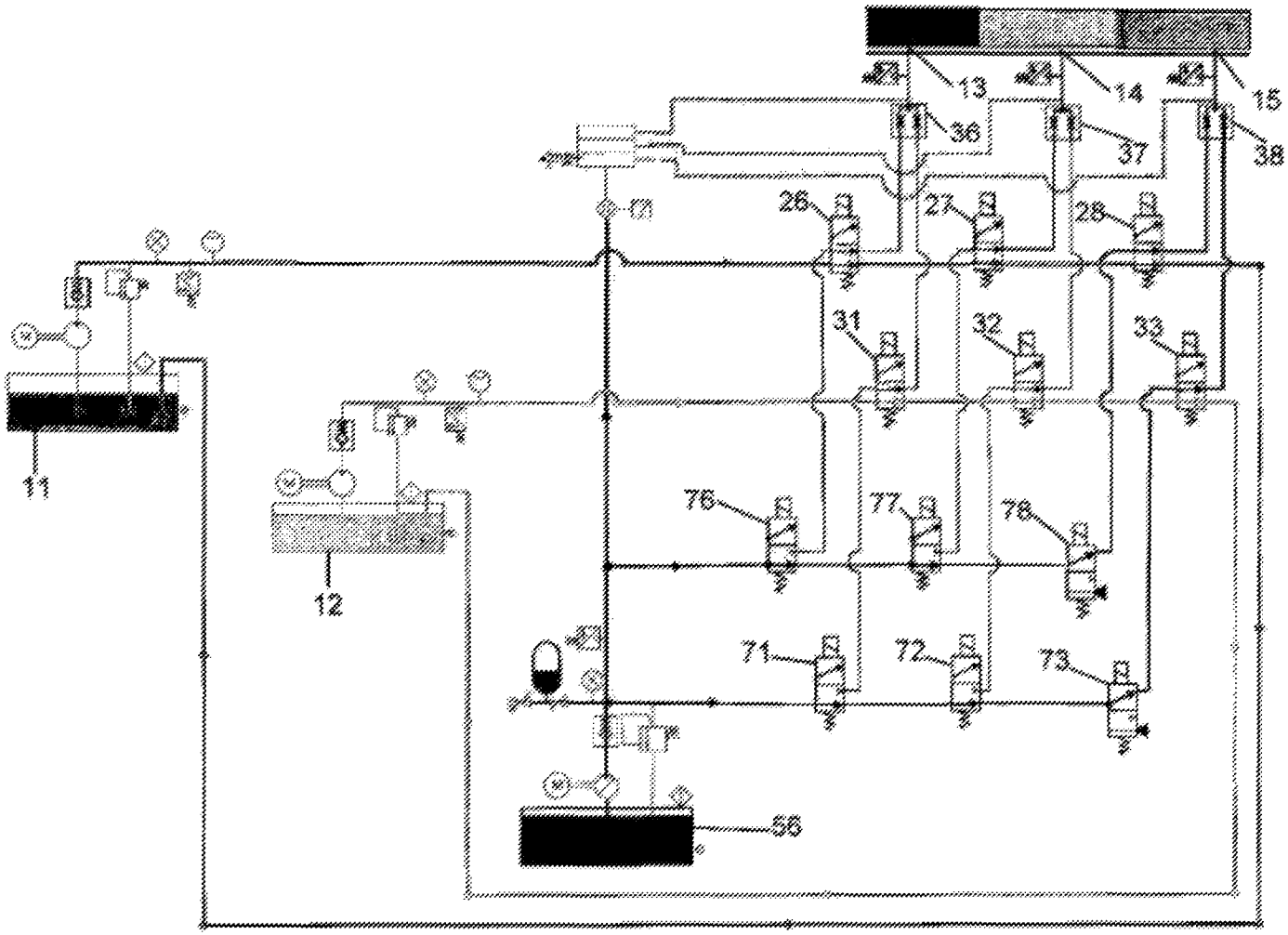
Figure 6A:
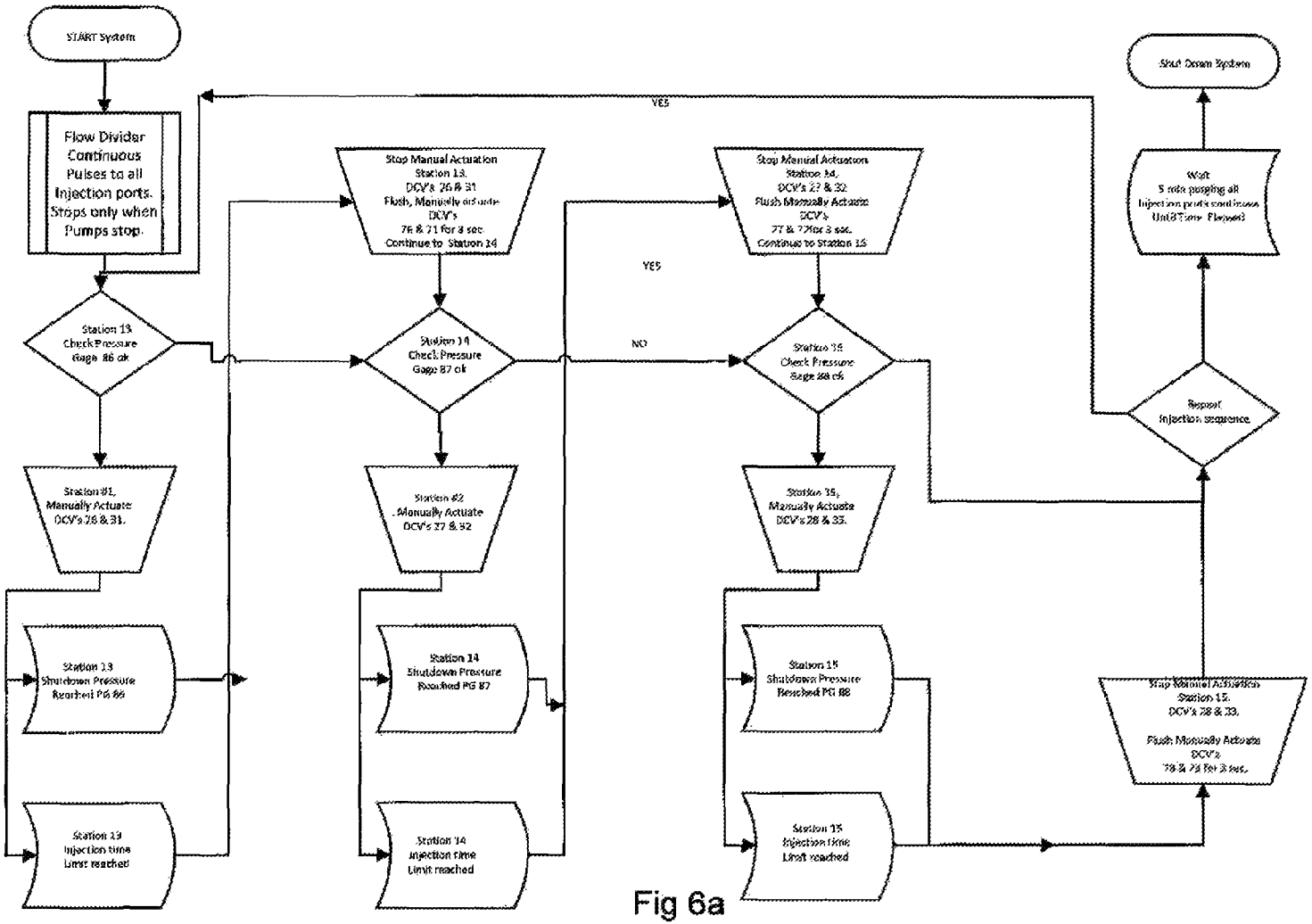
Figure 8B:
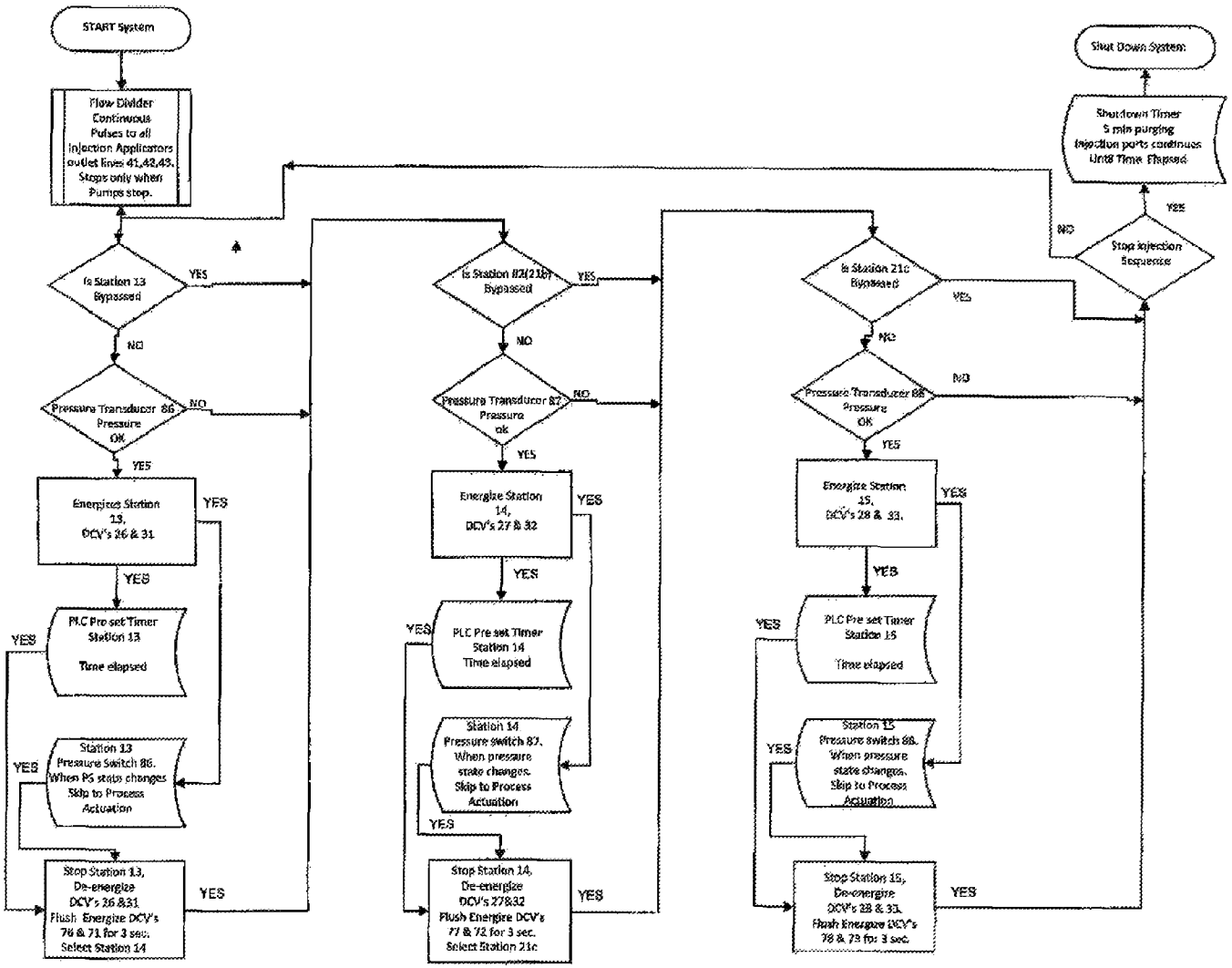
Figure 7:
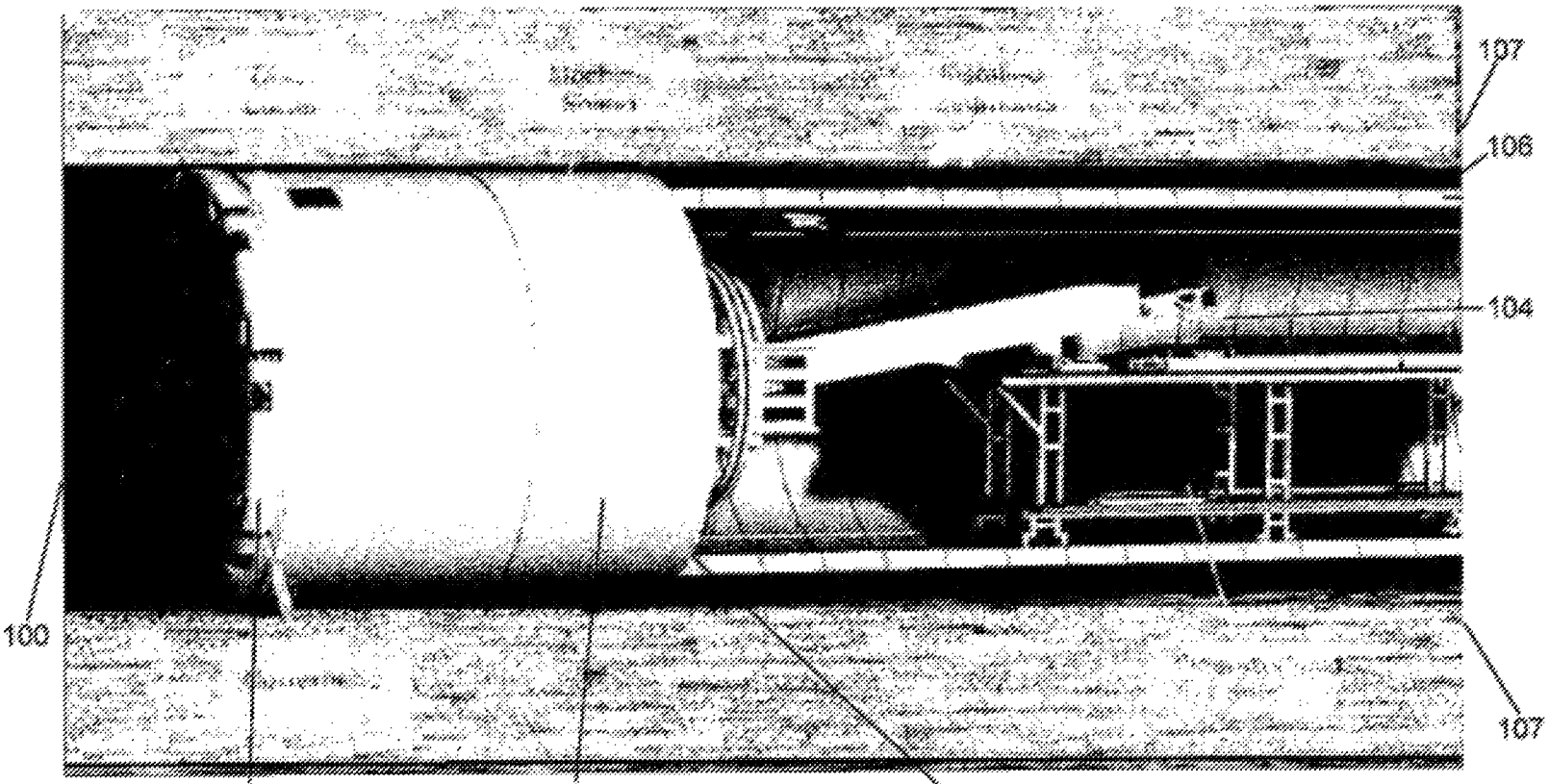

In order that this invention may be more readily understood and put into practical effect, reference will now be made to the accompanying drawings which illustrate a preferred embodiment of the invention and wherein:

FIG. 1. is a schematic drawing of a barrier forming apparatus constructed in accordance with the invention, said barrier forming apparatus having three applicators A, B and C, all of which are unobstructed and available to be used to disburse a barrier mixture;

FIG. 2. is a schematic drawing of the barrier forming apparatus shown in FIG. 1 but wherein applicator A is being used to disburse the barrier mixture;

FIG. 3. is a schematic drawing of the barrier forming apparatus shown in FIG. 1 but wherein applicator B is being used to disburse the barrier mixture while any residue barrier mixture retained in applicator A is being flushed therefrom;

FIG. 4. is a schematic drawing of the barrier forming apparatus shown in FIG. 1 but wherein applicator C is being used to disburse the barrier mixture while any residue barrier mixture retained in applicator B is being flushed therefrom;

FIG. 5. is a schematic drawing of the barrier forming apparatus shown in FIG. 1 but wherein any residue barrier mixture retained in applicator C is being flushed therefrom;

FIG. **6*a* is a flow diagram illustrating manual operation of the barrier forming apparatus shown in FIG. 1**;

FIG. **6*b* is a flow diagram illustrating programmed control of the barrier forming apparatus shown in FIG. 1, and FIG. 7** is a cross-sectional side view of a typical tunnel boring machine.

FIGS. 1 to 5 show a barrier forming apparatus 10 for forming a barrier between say a tunnel boring machine and an exposed tunnel face created by a tunnel boring machine during excavation of tunnels. The barrier is formed by applying to the surface a barrier mixture comprising two highly reactive first and second components.

The barrier forming apparatus 10 includes a first reservoir 11 for storing the first component, a second reservoir 12 for storing the second component, and a plurality of applicators which may be arranged in one or more rows. For simplicity, FIGS. 1 to 5 show only three applicators 13, 14 and 15. However, it will be appreciated that the barrier forming apparatus may typically include more than three applicators. Each applicator 13, 14 and 15 includes a respective inlet and a respective outlet.

The reservoir 11 includes an inlet 16 and an outlet 17. The inlet 16 and outlet 17 are connected to one another by a house line 18 and whereby there is provided a pump 19 that is capable of providing a continuous flow of the first component through the hose line 18 from the outlet 16 to the inlet 17.

The reservoir 12 includes an inlet 21 and an outlet 22. The inlet 21 and outlet 22 are connected to one another by a house line 23 and whereby there is provided a pump 24 that is capable of providing a continuous flow of the second component through the hose line 23 from the outlet 22 to the inlet 21.

The hose line 18 is connected to both a first inlet and a first outlet of each of three direction control valves 26, 27 and 28 such that when each of the control valves is in an "inoperative state", as shown in FIG. 1, the first component may flow unimpeded from the outlet 17 to the inlet 16 of the reservoir 11.

The hose line 23 is connected to both a first inlet and a first outlet of each of three direction control valves 31, 32 and 33 such that when each of the control valves is in an "inoperative state", as shown in FIG. 1, the second component may flow unimpeded from the outlet 22 to the inlet 21 of the reservoir 12.

The barrier forming apparatus 10 also includes three mixing chambers 36, 37 and 38 each having a first and second inlet and an outlet. Each outlet is connected via a hose line 41, 42 and 43 to a respective inlet of one of the three applicators 13, 14 and 15.

The first inlet of each of the three mixing chambers 36, 37 and 38 is connected to a respective second outlet of one of the three direction control valves 26, 27 and 28 via a hose line 46, 47 and 48.

The second inlet of each of the three mixing chambers 36, 37 and 38 is connected to a respective second outlet of one of the three directional control valves 31, 32 and 33 via a hose line 51, 52 and 53.

The barrier forming apparatus 10 also includes a third reservoir 56, having an outlet 57. The third reservoir 57 is used to store a clearing fluid that is known not to react with the first and second components, such as a suitable oil, and which preferably will not assist in the erosion and/or degradation of the exposed tunnel face as loose earth could block the outlet of one or more of the applicators.

The barrier forming apparatus 10 also includes a piston flow divider 58 having an inlet 59 and three chambers having respective outlets, 61, 62 and 63. The inlet 59 is connected to the third reservoir 56 by a hose line 64, and whereby a pump 65, that is connected both to the inlet 57 and the hose line 64, is used to provide a continuous supply of clearing fluid to the inlet 59 of the piston flow divider 58.

There are also provided two branch hose lines 66 and 67 that are each in fluid communication with hose line 64 and along which clearing fluid may flow. The hose line 66 is connected to both a first inlet and a first outlet of each of three direction control valves 71, 72 and 73 such that when each of the control valves is in an "inoperative state", as shown in FIG. 1, each of said direction control valves has an available supply of clearing fluid pumped thereto by pump 65 along hose line 66.

The hose line 67 is connected to both a first inlet and a first outlet of each of three direction control valves 76, 77 and 78 such that when each of the control valves is in an "inoperative state", as shown in FIG. 1, each of said directional control valves has an available supply of clearing fluid pumped thereto by pump 65 along hose line 67.

Each of the direction control valves 31, 32 and 33 have a second inlet that is connected to a second outlet of a respective one of the direction control valves 71, 72 and 73. Each of the direction control valves 31, 32 and 33 are also provided with a second outlet which is connected to a first inlet of a respective one of the mixing chambers 36, 37 and 38.

Each of the direction control valves 26, 27 and 28 have a second inlet that is connected to a second outlet of a respective one of the direction control valves 76, 77 and 78. Each of the direction control valves 26, 27 and 28 are also provided with a second outlet which is connected to a second inlet of a respective one of the mixing chambers 36, 37 and 38.

The outlets 61, 62 and 63 of the piston flow divider 58 are connected to hose lines 41, 42 and 43 respectively by hose lines 83, 82 and 81. Further there are provided sensors 86, 87 and 88 contained in hose lines 41, 42 and 43 respectively for determining the pressure of the clearing fluid flowing through said line.

FIG. 7 shows a typical tunnel boring machine 100 that may be used to create tunnels having a generally circular shaped transverse cross-section. The tunnel boring machine 100 includes a forwardly located, substantially circular shaped, rotating cutting wheel, or cutter head, 101 that when brought to bear against rock located in front of the machine will create compressive fractures in the rock which will lead to the formation of rock chips. These chips, known as muck, are transferred through openings in the cutter head to a belt conveyer, where they are transferred to a system of conveyers and/or cars for removal from the tunnel.

The cutter head 101 is supported by a main bearing located behind the cutter head.

The cutter head 101 is moved progressively forward by a thrust system 103 and is supported in its operative position by various trailing support mechanisms 104.

The tunnel boring machine 100 also includes a shield 102 that forms a protective shroud around the main bearing and the thrust system 103.

The cutter head 101 is adapted to cut a tunnel diameter that is larger than the normal tunnel diameter. The larger over bored tunnel diameter provides increased annular clearances 106 between the shield 102 and the excavated tunnel profile 107.

The tunnel boring machine 100 also includes a barrier forming apparatus 10, as previously described with reference to FIG. 1, for forming a barrier that will at least partially fill the annular clearance 106 comprising a fast curing, expandable, barrier mixture of the highly reactive first and second components. The barrier in use will provide passive support and protection from material ingress for the tunnel boring machine.

The outlet of each of the applicators 13, 14 and 15 is aligned with an opening formed in the shield 102 and whereby the applicators are adapted to apply the barrier mixture to the excavated tunnel profile situated nearby. The applicators may be arranged in one or more rows and may be located on the top and on the sides of the tunnel boring machine.

FIGS. 2 to 6 generally illustrate the barrier forming apparatus 10 in use.

The apparatus 10 has been designed such that a continuous supply of clearing fluid, drawn from the third reservoir 56, is conveyed along hose line 64 under pressures up to 300 bar, by pump 65, to the inlet 59 of the piston flow divider 58. The piston flow divider 58 in turn repeatedly diverts the supply of clearing fluid between one of three chambers 61, 62 or 63 thereby creating pulses of clearing fluid that flow along hose lines 81, 82 and 83 and eventually to be discharged through the outlet of respective applicators 13, 14 and 15.

The pressure caused by these pulses of clearing fluid flowing through hose lines 41, 42 and 43 are continually measured by sensors 86, 87 and 88 respectively, and wherein these measurements are monitored by control means, not shown. In doing so it is possible to determine whether the applicator is free of obstructions, as might be indicated by pressure that does not exceed a predetermined level, and therefore is indicative that the applicator is available to be used to disburse the barrier mixture.

It will also be appreciated that the control means upon receiving information concerning a build up of pressure in a hose line, possibly caused by a decrease in the volume of the void between the shield of the tunnel boring machine and the exposed tunnel face, may in some embodiments trigger the actuation means thereby initiating the mixing of the two components and the eventual discharge of the resulting barrier mixture from an associated applicator.

The sensors 86, 87 and 88 are also used to measure the resistance to the flow of barrier mixture through hose lines 41, 42 and 43, as might be caused by a build up of barrier mixture in the vicinity of the outlet of the applicator to which said line is attached, and wherein these measurements are conveyed to the control means which has been pre-programmed to terminate the production of barrier mixture in the mixing chamber that is in fluid communication with the applicator and to initiate the clearing of residue barrier mixture from the mixing chamber and the applicator.

Alternatively, the production of barrier mixture may be time dependent and whereby after a predetermined time period has elapsed production of barrier mixture will cease and clearing of residue barrier mixture from the mixing chamber and associated applicator will occur.

Depending upon the prevailing circumstances, the control means may also initiate production of barrier mixture in another one of the mixing chambers and the discharge of the barrier mixture through the applicator that is in fluid communication with said mixing chamber.

By way of example, FIG. 2 shows the barrier forming apparatus 10 when the applicator 13 is used to disburse barrier mixture into the void between it and the adjacent tunnel excavation profile.

To facilitate the production of the barrier mixture the state of direction control valves 26 and 31 have both been altered so as to redirect the flow of the first and second components into the mixing chamber 36.

With reference to FIG. 2, the status of the direction control valve 26 has been altered such that the flow of the first component entering the valve's first inlet is diverted to the second outlet which is in fluid communication with the first inlet of the mixing chamber 36. As a consequence the mixing chamber 36 is provided with a continuous supply of the first component, and, due to the altered state of the valve 26, the supply of the first component to directional control valves 27 and 28 has temporarily been discontinued.

Similarly, the status of the direction control valve 31 has been altered such that the flow of the second component entering the valve's first inlet is diverted to the second outlet which is in fluid communication with the second inlet of the mixing chamber 36. As a consequence the mixing chamber 36 is provided with a continuous supply of the second component, and, due to the altered state of the valve 31, the supply of the second component to directional control valves 32 and 33 has temporarily been discontinued.

Meanwhile the piston flow divider 58 continues to direct pulses of clearing fluid through applicators 13, 14 and 15, thereby maintaining applicators 14 and 15 clear of obstructions and available for use when required.

After a predetermined time period, or when the pressure of barrier mixture flowing along hose line 41 reaches a predetermined level, or a predetermined volume of barrier mixture has been dispensed, the control means shall terminate the production of barrier mixture in mixing chamber 36 by altering the state of direction control valves 26 and 31 such that they return to their preproduction state whereby the flow of components there through passes from the valve inlet to the first valve outlet, as illustrated in FIG. 3. This again permits the supply of the first and second components to respective directional control valves 32 and 27, the state of which has been altered so as to enable the production of barrier mixture in mixing chamber 37 and the disbursement of the barrier mixture by applicator 14, (see FIG. 3).

As was the case with the operation of applicator 13, the status of the direction control valve 27 has been altered such that the flow of the first component entering the valve is diverted to the second outlet which is in fluid communication with the first inlet of the mixing chamber 37.

Similarly, the status of the direction control valve 32 has been altered such that the flow of the second component entering the valve is diverted to the second outlet which is in fluid communication with the second inlet of the mixing chamber 37.

Simultaneously, the status of direction control valves 71 and 76 are altered so as to permit the flow of clearing fluid into the mixing chamber 36.

With reference to FIG. 3, the status of the direction control valve 71 has been altered such that the flow of the clearing fluid entering the valve is diverted to the second outlet which is in fluid communication with the second inlet and second outlet of the directional control valve 31, thereby permitting the clearing fluid to flow into the mixing chamber 36 via the chamber's second inlet.

Similarly, the status of the direction control valve 76 has been altered such that the flow of the clearing fluid entering the valve is diverted to the second outlet which is in fluid communication with the second inlet and second outlet of the direction control valve 26, thereby permitting the clearing fluid to flow into the mixing chamber 36 via the chamber's first inlet.

The clearing fluid entering the mixing chamber 36 is used to flush any residue barrier mixture contained in the chamber through the chamber's outlet and eventually out through the outlet of applicator 13 via hose line 41, and thereby also expunging from the hose line 41 and the applicator 13 any residue barrier mixture contained therein.

It is envisaged that the flushing of mixing chamber 36 and applicator 13 will continue for a predetermined period of time after which the status of direction control valves 71 and 76 will be altered such that they return to their pre-flushing state and thereby prevent further flow of clearing fluid into the mixing chamber 36. In particular, clearing fluid entering the valve 71 will be diverted to the first outlet. Similarly, clearing fluid entering the valve 76 will be diverted to the first outlet.

After a predetermined time period, or when the pressure of barrier mixture flowing along hose line 42 reaches a predetermined level, or a predetermined volume of barrier mixture has been dispensed, the control means shall terminate the production of barrier mixture in mixing chamber 37 by altering the state of direction control valves 27 and 32 such that they return to their preproduction state whereby the flow of components there through passes from the valve inlet to the first valve outlet, as illustrated in FIG. 4. This again permits the supply of the first and second components to respective directional control valves 33 and 28, the state of which has been altered so as to enable the production of barrier mixture in mixing chamber 38 and the disbursement of the barrier mixture by applicator 15, (see FIG. 4).

As was the case with the operation of applicator 14, the status of the direction control valve 28 has been altered such that the flow of the first component entering the valve is diverted to the second outlet which is in fluid communication with the first inlet of the mixing chamber 38.

Similarly, the status of the direction control valve 33 has been altered such that the flow of the second component entering the valve is diverted to the second outlet which is in fluid communication with the second inlet of the mixing chamber 38.

Simultaneously, the status of direction control valves 72 and 77 are altered so as to permit the flow of clearing fluid into the mixing chamber 37.

With reference to FIG. 4, the status of the direction control valve 72 has been altered such that the flow of the clearing fluid entering the valve is diverted to the second outlet which is in fluid communication with the second inlet and second outlet of the directional control valve 32, thereby permitting the clearing fluid to flow into the mixing chamber 37 via the chamber's second inlet.

Similarly, the status of the direction control valve 77 has been altered such that the flow of the clearing fluid entering the valve is diverted to the second outlet which is in fluid communication with the second inlet and second outlet of the direction control valve 27, thereby permitting the clearing fluid to flow into the mixing chamber 37 via the chamber's first inlet.

The clearing fluid entering the mixing chamber 37 is used to flush any residue barrier mixture contained in the chamber through the chamber's outlet and eventually out through the outlet of applicator 14 via hose line 42, and thereby also expunging from the hose line 42 and the applicator 14 any residue barrier mixture contained therein.

It is envisaged that the flushing of mixing chamber 37 and applicator 14 will continue for a predetermined period of time after which the status of direction control valves 72 and 77 will be altered so as to prevent the flow of clearing fluid into the mixing chamber 37. In particular, clearing fluid entering the valve 72 will be diverted to the first outlet. Similarly, clearing fluid entering the valve 77 will be diverted to the first outlet.

After a predetermined time period, or when the pressure of barrier mixture flowing along hose line 43 reaches a predetermined level, or a predetermined volume of barrier mixture has been dispensed, the control means shall terminate the production of barrier mixture in mixing chamber 38 by altering the state of direction control valves 28 and 33 such that they return to their preproduction state whereby the flow of components there through passes from the valve inlet to the first valve outlet, as illustrated in FIG. 5. This again permits the supply of the first and second components to respective directional control valves 31 and 26, the state of which has been altered so as to enable the production of barrier mixture in mixing chamber 36 and the disbursement of the barrier mixture by applicator 13, (see FIG. 5).

As was the case with the operation of applicator 15, the status of the direction control valve 26 has been altered such that the flow of the first component entering the valve is diverted to the second outlet which is in fluid communication with the first inlet of the mixing chamber 36.

Similarly, the status of the direction control valve 31 has been altered such that the flow of the second component entering the valve is diverted to the second outlet which is in fluid communication with the second inlet of the mixing chamber 36.

Simultaneously, the status of direction control valves 73 and 78 are altered so as to permit the flow of clearing fluid into the mixing chamber 38.

With reference to FIG. 5, the status of the direction control valve 73 has been altered such that the flow of the clearing fluid entering the valve is diverted to the second outlet which is in fluid communication with the second inlet and second outlet of the directional control valve 33, thereby permitting the clearing fluid to flow into the mixing chamber 38 via the chamber's second inlet.

Similarly, the status of the direction control valve 78 has been altered such that the flow of the clearing fluid entering the valve is diverted to the second outlet which is in fluid communication with the second inlet and second outlet of the direction control valve 28, thereby permitting the clearing fluid to flow into the mixing chamber 38 via the chamber's first inlet.

The clearing fluid entering the mixing chamber 38 is used to flush any residue barrier mixture contained in the chamber through the chamber's outlet and eventually out through the outlet of applicator 15 via hose line 43, and thereby also expunging from the hose line 43 and the applicator 15 any residue barrier mixture contained therein.

It is envisaged that the flushing of mixing chamber 38 and applicator 15 will continue for a predetermined period of time after which the status of direction control valves 73 and 78 will be altered so as to prevent the flow of clearing fluid into the mixing chamber 38. In particular, clearing fluid entering the valve 73 will be diverted to the first outlet. Similarly, clearing fluid entering the valve 78 will be diverted to the first outlet.

However, if after applicator 15 has completed the disbursement of barrier mixture it is determined that there is no need to employ applicator 13 to disburse additional barrier mixture, then after the mixing chamber 38 and applicator 15 have been flushed with clearing fluid, the barrier forming apparatus may revert to the state as depicted in FIG. 2.

It will be appreciated that the short pulses of clearing fluid assist in maintaining the applicators ready for use and help prevent the applicators from becoming blocked by the ingress of the fast curing barrier mixture as it expands to form a barrier in the vicinity of the applicators.

Further, monitoring the pressure of the pulses of clearing fluid adjacent the applicator outlet enables users to better determine the condition of the ground in the vicinity of the applicator outlet and thereby commence disbursement of the barrier mixture before changes in geological conditions might otherwise prevent, or severely inhibit, the disbursement of the barrier mixture and the construction of a protective barrier. A worsening of conditions in the vicinity of the applicator may be reflected by a build up in the pressure of the clearing fluid exiting the applicator outlet.

It will also be appreciated that the use of short pulses of clearing fluid delivered under very high pressure, economically and efficiently delivers small quantities of sacrificial clearing fluid therefore maintaining all applicators clear of blockages.

It will also be appreciated that the barrier forming apparatus described above requires only one pump to supply each component to all of the mixing chambers and as a consequence it is very efficient.

It will of course be realised that while the foregoing description has been given by way of example of this invention, all other modifications and variations thereto as would be apparent to persons skilled in the art are deemed to fall within the broad scope and ambit of this invention as herein defined in the appended claims.

The claims defining the invention are as follows:

1. A barrier forming apparatus for forming a barrier between an exposed tunnel face and a tunnel boring machine, the barrier being formed by the application to the tunnel face of a barrier mixture comprising two highly reactive first and second components, said barrier forming apparatus including:

- a first reservoir for storing the first component;
- a second reservoir for storing the second component;
- an applicator having an applicator outlet and an applicator inlet;
- a mixing chamber having a first port that is in fluid communication with said first reservoir, a second port that is in fluid communication with said second reservoir and a third port that is in fluid communication with said applicator inlet;

clearing means that is adapted to expel residue barrier mixture contained in said applicator and said mixing chamber through said applicator, including a third reservoir for storing a clearing fluid, said third reservoir being in fluid communication with said applicator, and supply means for providing a regular flow of the clearing fluid to said applicator, and control means having monitoring means for monitoring the resistance to the flow of the clearing fluid through said applicator outlet, and actuation means for actuating the production of the barrier mixture in said mixing chamber and its subsequent disbursement by said applicator, whereby production of the barrier mixture may occur if there is no resistance to the flow of clearing fluid passing through said applicator outlet or the level of resistance does not exceed a predetermined limit.

2. A barrier forming apparatus as claimed in claim 1, wherein said third reservoir is also in fluid communication with said first and said second ports of said mixing chamber and whereby in use clearing fluid may enter said mixing chamber via said ports by an alternative path, or paths, to that used to provide a regular supply of the clearing fluid to said applicator.

3. A barrier forming apparatus as claimed in claim 2, wherein said supply means includes a pump and wherein said pump is used to supply clearing fluid to said mixing chamber via said first and second paths.

4. A barrier forming apparatus as claimed in claim 3, wherein said control means also controls the quantity of barrier mixture that is produced and shall initiate clearing of said mixing chamber and said applicator upon termination of the production of the barrier mixture.

5. A barrier forming apparatus for forming a barrier between an exposed tunnel face and a tunnel boring machine, the barrier being formed by the application to the tunnel face of a barrier mixture comprising two highly reactive first and second components, said barrier forming apparatus including:

a first reservoir for storing the first component;

a second reservoir for storing the second component;

an applicator having an applicator outlet and an applicator inlet;

a mixing chamber having a first port that is in fluid communication with said first reservoir, a second port that is in fluid communication with said second reservoir and a third port that is in fluid communication with said applicator inlet;

clearing means that is adapted to expel residue barrier mixture contained in said applicator and said mixing chamber through said applicator, including a third reservoir for storing a clearing fluid that is in fluid communication with said first and said second ports via respective first and second paths, said third reservoir being also in fluid communication with said applicator via a third path and whereby said clearing means includes supply means for providing a regular supply of the clearing fluid to said applicator via said third path, and control means having monitoring means for monitoring the resistance to the flow of the clearing fluid through said applicator outlet, and actuation means for actuating the production of the barrier mixture in said mixing chamber and its subsequent disbursement by said applicator, whereby production of the barrier mixture may occur if there is no resistance to the flow of clearing fluid passing through said applicator outlet or the level of resistance does not exceed a predetermined limit.

6. A barrier forming apparatus as claimed in claim 5, wherein said supply means includes a pump and wherein said pump is used to supply clearing fluid to said mixing chamber via said first and second paths.

7. A barrier forming apparatus as claimed in claim 6, wherein said control means also controls the quantity of barrier mixture that is produced and shall initiate clearing of said mixing chamber and said applicator upon termination of the production of the barrier mixture.

8. A barrier forming apparatus for forming a barrier between an exposed tunnel face and a tunnel boring machine, the barrier being formed by the application to the tunnel face of a barrier mixture comprising two highly reactive first and second components, said barrier forming apparatus including:

a first reservoir for storing the first component;

a second reservoir for storing the second component;

a plurality of applicators each having an applicator outlet and an applicator inlet;

a plurality of mixing chambers each having a first port that is in fluid communication with said first reservoir, a second port that is in fluid communication with said second reservoir and a third port that is in fluid communication with a respective one of said applicator inlets;

clearing means that is adapted to expel residue barrier mixture contained in said applicators and said mixing chambers through said applicators, including a third reservoir for storing a clearing fluid, said third reservoir being in fluid communication with each of said applicators, and supply means for supplying a regular flow of the clearing fluid to each of said applicators;

control means having monitoring means for monitoring the resistance to the flow of the clearing fluid through said applicator outlets, and actuation means for actuating the production of the barrier mixture in said mixing chambers and its subsequent disbursement by said applicators, whereby the production of barrier mixture in any one of said mixing chambers may occur if there is no resistance to the flow of clearing fluid passing through said applicator in fluid communication with said mixing chamber, or the level of resistance does not exceed a predetermined limit.

9. A barrier forming apparatus for forming a barrier between an exposed tunnel face and a tunnel boring machine, the barrier being formed by the application to the surface of a barrier mixture comprising two highly reactive first and second components, said barrier forming apparatus including:

a first reservoir for storing the first component;

a second reservoir for storing the second component;

a plurality of applicators each having an applicator outlet and an applicator inlet;

a plurality of mixing chambers each having a first port that is in fluid communication with said first reservoir, a second port that is in fluid communication with said second reservoir and a third port that is in fluid communication with a respective one of said applicator inlets;

clearing means that is adapted to expel residue barrier mixture contained in said applicators and said mixing chambers through said applicators, including a third reservoir for storing a clearing fluid, said third reservoir being in fluid communication with each of said applicators, and supply means for supplying a regular flow of the clearing fluid to each of said applicators;

control means having monitoring means for the sequential monitoring of resistance to the flow of the clearing fluid through each of said applicator outlets, and actuation means for actuating the production of the barrier mixture in said mixing chambers in sequential order and its subsequent disbursement by said applicators and the clearing of barrier mixture from said mixing chambers and said applicators immediately the supply of reagents to a mixing chamber is terminated, and whereby the production of barrier mixture in any one of said mixing chambers may occur if there is no resistance to the flow of clearing fluid passing through said applicator in fluid communication with said mixing chamber, or the level of resistance does not exceed a predetermined limit.

10. A tunnel boring machine of the type having a forwardly located, rotating cutting wheel, followed by a main bearing, a thrust system and various trailing support mechanisms, said tunnel boring machine also having a barrier forming apparatus for forming a barrier between an exposed tunnel face and the tunnel boring machine adjacent the machine, the barrier being formed by the application to the surface of a barrier mixture comprising two highly reactive first and second components, said tunnel boring machine including:

a first reservoir for storing the first component;

a second reservoir for storing the second component;

an applicator having an applicator outlet and an applicator inlet;

a mixing chamber having a first port that is in fluid communication with said first reservoir, a second port that is in fluid communication with said second reservoir and a third port that is in fluid communication with said applicator inlet;

clearing means that is adapted to expel residue barrier mixture contained in said applicator and said mixing chamber through said applicator, including a third reservoir for storing a clearing fluid, said third reservoir being in fluid communication with said applicator, and supply means for providing a regular flow of the clearing fluid to said applicator, and control means having monitoring means for monitoring the resistance to the flow of the clearing fluid through said applicator outlet, and actuation means for actuating the production of the barrier mixture in said mixing chamber and its subsequent disbursement by said applicator, whereby production of the barrier mixture may occur if there is no resistance to the flow of clearing fluid passing through said applicator outlet or the level of resistance does not exceed a predetermined limit.

* * * * *